US009603395B2

(12) United States Patent
Duffy

(10) Patent No.: US 9,603,395 B2
(45) Date of Patent: Mar. 28, 2017

(54) FILTERING FACE-PIECE RESPIRATOR HAVING DARTED MASK BODY

(71) Applicant: 3M INNOVATIVE PROPERTIES COMPANY, St. Paul, MN (US)

(72) Inventor: Dean R. Duffy, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 513 days.

(21) Appl. No.: 14/013,314

(22) Filed: Aug. 29, 2013

(65) Prior Publication Data

US 2015/0059772 A1 Mar. 5, 2015

(51) Int. Cl.
*A41D 13/11* (2006.01)
*A62B 23/02* (2006.01)

(52) U.S. Cl.
CPC ..... *A41D 13/1115* (2013.01); *A41D 13/1161* (2013.01); *A62B 23/025* (2013.01); *Y10T 29/49604* (2015.01)

(58) Field of Classification Search
CPC ..... A62B 23/025; A62B 23/00; A62B 23/02; A62B 23/06
See application file for complete search history.

(56) References Cited

U.S. PATENT DOCUMENTS

| | | | | |
|---|---|---|---|---|
| 1,946,334 A | | 2/1934 | Schwartz | |
| 3,971,369 A | | 7/1976 | Aspelin et al. | |
| 4,248,220 A | * | 2/1981 | White | A41D 13/1123 128/206.16 |
| 4,300,549 A | | 11/1981 | Parker | |
| 4,850,347 A | | 7/1989 | Skov | |
| 5,322,061 A | | 6/1994 | Brunson | |
| 5,553,608 A | * | 9/1996 | Reese | A41D 13/1115 128/206.19 |
| 6,055,982 A | * | 5/2000 | Brunson | A41D 13/1115 128/205.27 |
| 6,403,197 B1 | | 6/2002 | Skov et al. | |
| 7,677,248 B2 | | 3/2010 | Gerson et al. | |
| 2006/0130214 A1 | * | 6/2006 | Steindorf | A41D 13/1115 2/206 |
| 2010/0051032 A1 | * | 3/2010 | Kim | A62B 23/025 128/206.19 |
| 2010/0154805 A1 | | 6/2010 | Duffy et al. | |
| 2012/0060843 A1 | | 3/2012 | Magdison et al. | |

FOREIGN PATENT DOCUMENTS

| | | |
|---|---|---|
| JP | 3117500 | 1/2006 |
| WO | WO 2011/052454 | 5/2011 |
| WO | WO 2013/055131 | 4/2013 |

OTHER PUBLICATIONS

International Application PCT/US2014/051072 Search Report dated Apr. 24, 2015.

* cited by examiner

*Primary Examiner* — Tarla Patel

(57) ABSTRACT

A cup-shaped filtering face-piece respirator 10 that includes a harness 14 and a mask body 12 that has a multi-layer filtering structure 16. The mask body 12 includes at least one dart 60 permanently bonded in the filtering structure 16, the dart 60 tapering from a center plane 32 of the mask body 12 to a side edge of the mask body. The dart 60 inhibits collapse of the cup-shaped form of the respirator 10.

14 Claims, 5 Drawing Sheets

FILTERING FACE-PIECE RESPIRATOR HAVING DARTED MASK BODY

The present invention pertains to a filtering face-piece respirator that includes darts in the mask body to inhibit collapse of the mask body.

BACKGROUND

Respirators are commonly worn over a person's breathing passages for at least one of two common purposes: (1) to prevent impurities or contaminants from entering the wearer's respiratory system; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or clean room.

A variety of respirators have been designed to meet either (or both) of these purposes. Some respirators have been categorized as being "filtering face-pieces" because the mask body itself functions as the filtering mechanism. Unlike respirators that use rubber or elastomeric mask bodies in conjunction with attachable filter cartridges (see, e.g., U.S. Pat. No. RE39,493 to Yuschak et al.) or insert-molded filter elements (see, e.g., U.S. Pat. No. 4,790,306 to Braun), filtering face-piece respirators are designed to have the filter media cover much of the whole mask body so that there is no need for installing or replacing a filter cartridge. These filtering face-piece respirators commonly come in one of two configurations: molded respirators and flat-fold respirators.

Molded filtering face piece respirators have regularly comprised non-woven webs of thermally-bonding fibers or open-work plastic meshes to furnish the mask body with its cup-shaped configuration. Molded respirators tend to maintain the same shape during both use and storage. These respirators therefore cannot be folded flat for storage and shipping. Examples of patents that disclose molded, filtering, face-piece respirators include U.S. Pat. No. 7,131,442 to Kronzer et al, U.S. Pat. Nos. 6,923,182, 6,041,782 to Angadjivand et al., U.S. Pat. No. 4,807,619 to Dyrud et al., and U.S. Pat. No. 4,536,440 to Berg.

Flat-fold respirators—as their name implies—can be folded flat for shipping and storage. They also can be opened into a cup-shaped configuration for use. Examples of flat-fold respirators are shown in U.S. Pat. Nos. 6,568,392 and 6,484,722 to Bostock et al., and U.S. Pat. No. 6,394,090 to Chen. Some flat-fold respirators have been designed with weld lines, seams, and folds, to help maintain their cup-shaped configuration during use. Stiffening members also have been incorporated into panels of the mask body (see U.S. Patent Application Publications 2001/0067700 to Duffy et al., 2010/0154805 to Duffy et al., and U.S. Design Pat. No. 659,821 to Spoo et al.).

The present invention, as described below, provides an alternative construction of a filtering face-piece respirator configured to maintain its cup-shape.

SUMMARY OF THE INVENTION

The present invention provides a filtering face-piece respirator that comprises a mask body formed from a filtering structure. The mask body includes a dart permanently formed in the mask body to inhibit collapse of the respirator from its cup-shape, the dart transversely extending across the mask body and tapering at each of its ends. The dart is locked at its ends by a securement, such as a weld, which is distanced from the perimeter of the mask body. Between the securement and the perimeter of the mask body is usable, breathable filtering structure.

The dart increases the integrity of the mask body, when in the opened cup-shaped configuration, inhibiting collapse of the mask body, due to, for example, increased pressure drop across the mask body due to dirty or moisture laden air. The sealed ends of the dart permanently lock the position of the dart while the flexible center portion of the dart allows sufficient confirmation of the mask body to the wearer's face. Additionally, the flexible center portion of the dart allows sufficient flexibility in the mask body to accommodate for the wearer's head and facial movements.

GLOSSARY

The terms set forth below will have the meanings as defined:

"comprises" or "comprising" means its definition as is standard in patent terminology, being an open-ended term that is generally synonymous with "includes", "having", or "containing". Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the inventive respirator in serving its intended function;

"clean air" means a volume of atmospheric ambient air that has been filtered to remove contaminants;

"contaminants" means particles (including dusts, mists, and fumes) and/or other substances that generally may not be considered to be particles (e.g., organic vapors, etc.) but which may be suspended in air;

"crosswise dimension" is the dimension that extends laterally across the respirator, from side-to-side when the respirator is viewed from the front;

"cup-shaped configuration", and variations thereof, mean any vessel-type shape that is capable of adequately covering the nose and mouth of a person;

"dart" means a double-tapered region in the filtering structure of the mask body, the region having two fixed opposite ends and a center region having an adjustable width tapering to the fixed ends;

"exterior gas space" means the ambient atmospheric gas space into which exhaled gas enters after passing through and beyond the mask body and/or exhalation valve;

"exterior surface" means the surface of the mask body exposed to ambient atmospheric gas space when the mask body is positioned on the person's face;

"filtering face-piece" means that the mask body itself is designed to filter air that passes through it; there are no separately identifiable filter cartridges or insert-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filter media" means an air-permeable structure that is designed to remove contaminants from air that passes through it;

"filtering structure" and "breathable filtering structure" each means a generally air-permeable construction that filters air;

"folded inwardly" means being bent back towards the part from which extends;

"harness" means a structure or combination of parts that assists in supporting the mask body on a wearer's face;

"interior gas space" means the space between a mask body and a person's face;

"interior surface" means the surface of the mask body closest to a person's face when the mask body is positioned on the person's face;

"line of demarcation" means a fold, seam, weld line, bond line, stitch line, hinge line, and/or any combination thereof;

"mask body" means an air-permeable structure that is designed to fit over the nose and mouth of a person and that helps define an interior gas space separated from an exterior gas space (including the seams and bonds that join layers and parts thereof together);

"nose clip" means a mechanical device (other than a nose foam), which device is adapted for use on a mask body to improve the seal at least around a wearer's nose;

"perimeter" means the outer edge of the mask body, which outer edge would be disposed generally proximate to a wearer's face when the respirator is being donned by a person; a "perimeter segment" is a portion of the perimeter;

"pleat" means a portion that is designed to be or is folded back upon itself;

"polymeric" and "plastic" each mean a material that mainly includes one or more polymers and that may contain other ingredients as well;

"respirator" means an air filtration device that is worn by a person to provide the wearer with clean air to breathe; and "transversely extending" means extending generally in the crosswise dimension.

DETAILED DESCRIPTION OF PREFERRED EMBODIMENTS

Figure 1:
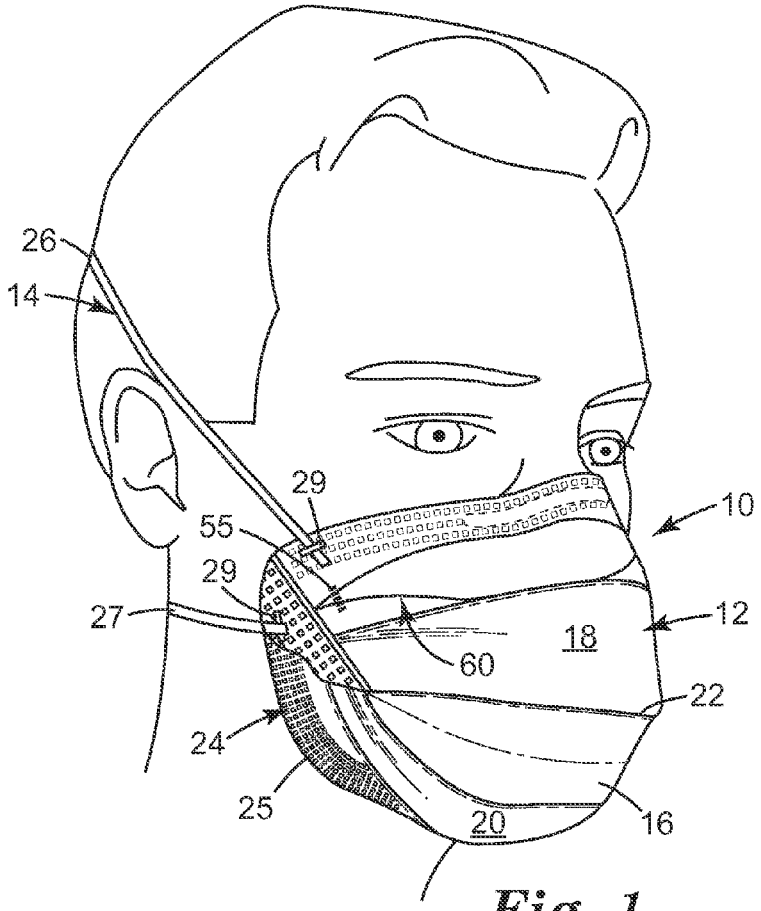
FIG. 1 is a front perspective view of a filtering face-piece respirator 10 being worn on a person's face, the respirator 10 having a dart 60.

In practicing the present invention, a filtering face-piece respirator is provided that has a permanent dart in the mask body of the respirator. The dart, formed by pleating the filtering structure and then sealing or bonding the pleat while the mask body is in a cup-shape, inhibits collapse of the respirator from its final cup-shape.

In the following description, reference is made to the accompanying drawings that form a part hereof and in which are shown by way of illustration various specific embodiments. The various elements and reference numerals of one embodiment described herein are consistent with and the same as the similar elements and reference numerals of another embodiment described herein, unless indicated otherwise. It is to be understood that other embodiments are contemplated and may be made without departing from the scope or spirit of the present invention. The following description, therefore, is not to be taken in a limiting sense. While the present invention is not so limited, an appreciation of various aspects of the invention will be gained through a discussion of the examples provided below.

Figure 2:
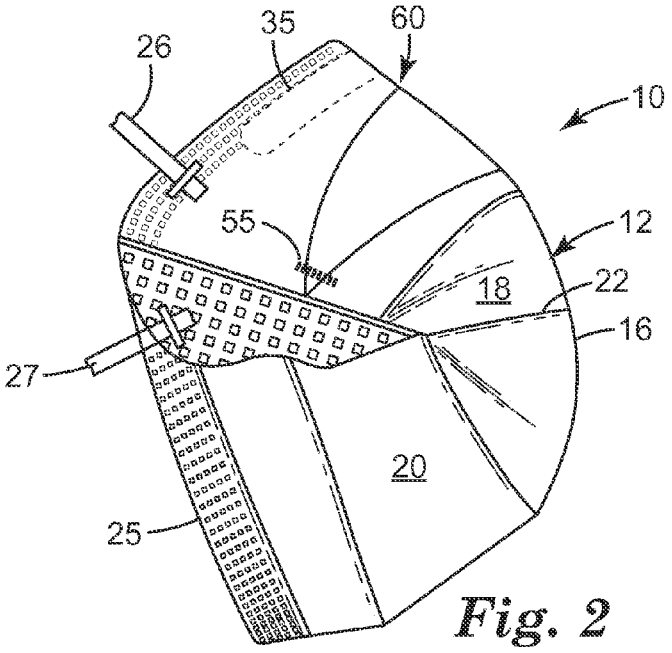
FIG. 2 is a side view of the respirator 10 of FIG. 1.

Turning to the figures, FIGS. 1 and 2 show an example of a filtering face-piece respirator 10 that may be used in connection with the present invention to provide clean air for the wearer to breathe. The filtering face-piece respirator 10 includes a mask body 12 and a harness 14. In this use-configuration, the mask body 12 has a cup-shape that is fairly rigid. The mask body 12 retains this cup shape and inhibits deforming from this shape unless an intentional force (e.g., pressure) is applied thereto.

The mask body 12 has a filtering structure 16 through which inhaled air must pass before entering the wearer's respiratory system. The filtering structure 16 removes contaminants from the ambient environment so that the wearer breathes clean air. The filtering structure 16 may take on a variety of different shapes and configurations and typically is adapted so that it properly fits against the wearer's face or within a support structure. Generally the shape and configuration of the filtering structure 16 corresponds to the general shape of the mask body 12.

The filtering structure 16 that is used in the mask body 12 can be of a particle capture or gas and vapor type filter. The filtering structure 16 also may be a barrier layer that prevents the transfer of liquid from one side of the filter layer to another to prevent, for instance, liquid aerosols or liquid splashes (e.g., blood) from penetrating the filter layer. Multiple layers of similar or dissimilar filter media may be used to construct the filtering structure 16 as the application requires. Filtration layers that may be beneficially employed in a layered mask body are generally low in pressure drop (for example, less than about 195 to 295 Pascals at a face velocity of 13.8 centimeters per second) to minimize the breathing work of the mask wearer. Filtration layers additionally may be flexible and may have sufficient shear strength so that they generally retain their structure under the expected use conditions.

The mask body 12 includes a top portion 18 and a bottom portion 20 separated by a line of demarcation 22. In this particular embodiment, the line of demarcation 22 is a fold or pleat that extends transversely across the central portion of the mask body from side-to-side. The mask body 12 also includes a perimeter 24 that defines a perimeter edge 25.

The harness 14 has a first, upper strap 26 that is secured to the top portion 18 of mask body 12 and a second, lower strap 27. The straps 26, 27 are secured to mask body 12 by staples 29. The straps 26, 27 may be made from a variety of materials, such as thermoset rubbers, thermoplastic elastomers, braided or knitted yarn and/or rubber combinations, inelastic braided components, and the like. The straps 26, 27 preferably can be expanded to greater than twice their total length and be returned to their relaxed state. The straps 26, 27 also could possibly be increased to three or four times their relaxed state length and can be returned to their original condition without any damage thereto when the tensile forces are removed. The straps 26, 27 may be continuous straps or may have a plurality of parts, which can be joined together by further fasteners or buckles. Alternatively, the straps may form a loop that is placed around the wearer's ears.

A nose clip 35 (FIG. 2) can be disposed on or in the top portion 18 of the mask body 12 adjacent to the perimeter 24, centrally positioned between the mask body side edges to assist in achieving an appropriate fit on and around the nose and upper cheekbones. The nose clip 35 may be made from a pliable metal or plastic that is capable of being manually adapted by the wearer to fit the contour of the wearer's nose. The nose clip 35 may comprise, for example, a malleable or pliable soft band of metal such as aluminum, which can be shaped to hold the mask in a desired fitting relationship over the nose of the wearer and where the nose meets the cheek.

In accordance with this invention, respirator 10 includes a permanent dart 60 in the filtering structure 16. The dart 60 is created when a transversely extending pleat is closed or locked at each end by a securement 55 (e.g., a weld) and opened at the center of the mask body 12. Thus the dart 60 tapers both directions from a central area of the mask body 12 to the side edges of the mask body 12. The securement 55 locks the construction and dimensions of the dart 60 at the location of securement 55, inhibiting the two edges of the dart 60 from closing upon themselves and thus collapsing the cup shape of the mask body 12. Details regarding the dart 60 and methods of forming it are described below in relation to FIGS. 4 through 9.

Respirator 10 includes other features that are not specifically called out in reference to FIG. 1 or 2, such as the side flanges, one of which is seen in FIGS. 1 and 2, but which are discussed in relation to FIG. 4 below. Additional details regarding the flanges and other features of respirator 10 and mask body 12 can be found in U.S. patent application Ser. No. 13/727,923 filed Dec. 27, 2012, titled "Filtering Face-Piece Respirator Having Folded Flange," the entire disclosure of which is incorporated herein by reference.

Figure 3:
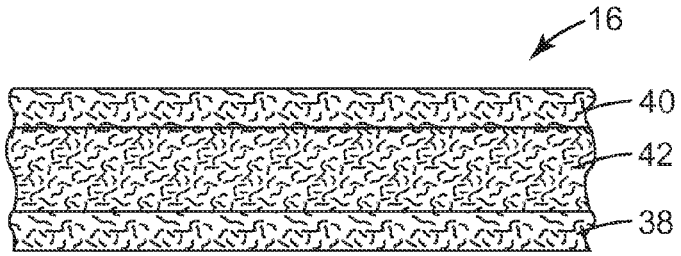
FIG. 3 is a cross-sectional view of a filtering structure 16 suitable for use in the respirator 10 of FIGS. 1 and 2.

FIG. 3 shows an exemplary filtering structure 16 of the mask body 12 having multiple layers such as an inner cover web 38, an outer cover web 40, and a filtration layer 42. The filtering structure 16 also may have a structural netting or mesh juxtaposed against at least one or more of the layers 38, 40, or 42, typically against the outer surface of the outer cover web 40, that assist in providing a cup-shaped configuration. The filtering structure 16 also could have one or more horizontal and/or vertical lines of demarcation (e.g., pleat, fold, or rib) that contribute to its structural integrity.

An inner cover web 38, which typically defines the interior surface of the mask body 12, can be used to provide a smooth surface for contacting the wearer's face, and an outer cover web 40, which typically defines the exterior surface of the mask body 12, can be used to entrap loose fibers in the mask body or for aesthetic reasons. Both cover webs 38, 40 protect the filtration layer 42. The cover webs 38, 40 typically do not provide any substantial filtering benefits to the filtering structure 16, although outer cover web 40 can act as a pre-filter to the filtration layer 42.

To obtain a suitable degree of comfort, the inner cover web 38 preferably has a comparatively low basis weight and is formed from comparatively fine fibers, often finer than those of outer cover web 40. Either or both cover webs 38, 40 may be fashioned to have a basis weight of about 5 to about 70 g/m$^2$ (typically about 17 to 51 g/m$^2$ and in some embodiments 34 to 51 g/m$^2$), and the fibers may be less than 3.5 denier (typically less than 2 denier, and more typically less than 1 denier) but greater than 0.1. Fibers used in the cover webs 38, 40 often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Typically, the cover webs 38, 40 are made from a selection of nonwoven materials that provide a comfortable feel, particularly on the side of the filtering structure that makes contact with the wearer's face, i.e., inner cover web 38. Suitable materials for the cover web may be blown microfiber (BMF) materials, particularly polyolefin BMF materials, for example polypropylene BMF materials (including polypropylene blends and also blends of polypropylene and polyethylene). Spun-bond fibers also may be used.

A typical cover web may be made from polypropylene or a polypropylene/polyolefin blend that contains 50 weight percent or more polypropylene. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. Cover webs 38, 40 preferably have very few fibers protruding from the web surface after processing and therefore have a smooth outer surface.

The filtration layer 42 is typically chosen to achieve a desired filtering effect. The filtration layer 42 generally will remove a high percentage of particles and/or or other contaminants from the gaseous stream that passes through it. For fibrous filter layers, the fibers selected depend upon the kind of substance to be filtered.

The filtration layer 42 may come in a variety of shapes and forms and typically has a thickness of about 0.2 millimeters (mm) to 5 mm, more typically about 0.3 mm to 3 mm (e.g., about 0.5 mm), and it could be a generally planar web or it could be corrugated to provide an expanded surface area. The filtration layer also may include multiple filtration layers joined together by an adhesive or any other means. Essentially any suitable material that is known (or later developed) for forming a filtering layer may be used as the filtering material. Webs of melt-blown fibers, especially when in a persistent electrically charged (electret) form are especially useful. Electrically charged fibrillated-film fibers also may be suitable, as well as rosin-wool fibrous webs and webs of glass fibers or solution-blown, or electrostatically sprayed fibers, especially in microfilm form. Also, additives can be included in the fibers to enhance the filtration performance of webs produced through a hydro-charging process. Fluorine atoms, in particular, can be disposed at the surface of the fibers in the filter layer to improve filtration performance in an oily mist environment.

Examples of particle capture filters include one or more webs of fine inorganic fibers (such as fiberglass) or polymeric synthetic fibers. Synthetic fiber webs may include electret-charged, polymeric microfibers that are produced from processes such as meltblowing. Polyolefin microfibers formed from polypropylene that has been electrically-charged provide particular utility for particulate capture applications. An alternate filter layer may comprise a sorbent component for removing hazardous or odorous gases from the breathing air. Sorbents may include powders or granules that are bound in a filter layer by adhesives, binders, or fibrous structures. A sorbent layer can be formed by coating a substrate, such as fibrous or reticulated foam, to form a thin coherent layer. Sorbent materials may include activated carbons that are chemically treated or not, porous alumina-silica catalyst substrates, and alumina particles.

Although the filtering structure 16 has been illustrated in FIG. 3 with one filtration layer 42 and two cover webs 38, 40, the filtering structure 16 may comprise a plurality or a combination of filtration layers 42. For example, a pre-filter may be disposed upstream to a more refined and selective downstream filtration layer. Additionally, sorptive materials such as activated carbon may be disposed between the fibers and/or various layers that comprise the filtering structure. Further, separate particulate filtration layers may be used in conjunction with sorptive layers to provide filtration for both particulates and vapors.

During respirator use, incoming air passes sequentially through layers 40, 42, and 38 before entering the mask interior. The air that is within the interior gas space of the mask body may then be inhaled by the wearer. When a wearer exhales, the air passes in the opposite direction sequentially through layers 38, 42, and 40. Alternatively, an exhalation valve (not shown) may be provided on the mask body 12 to allow exhaled air to be rapidly purged from the interior gas space to enter the exterior gas space without passing through filtering structure 16. The use of an exhalation valve may improve wearer comfort by rapidly removing the warm moist exhaled air from the mask interior. Essentially any exhalation valve that provides a suitable pressure drop and that can be properly secured to the mask body may be used in connection with the present invention to rapidly deliver exhaled air from the interior gas space to the exterior gas space.

Figure 4:
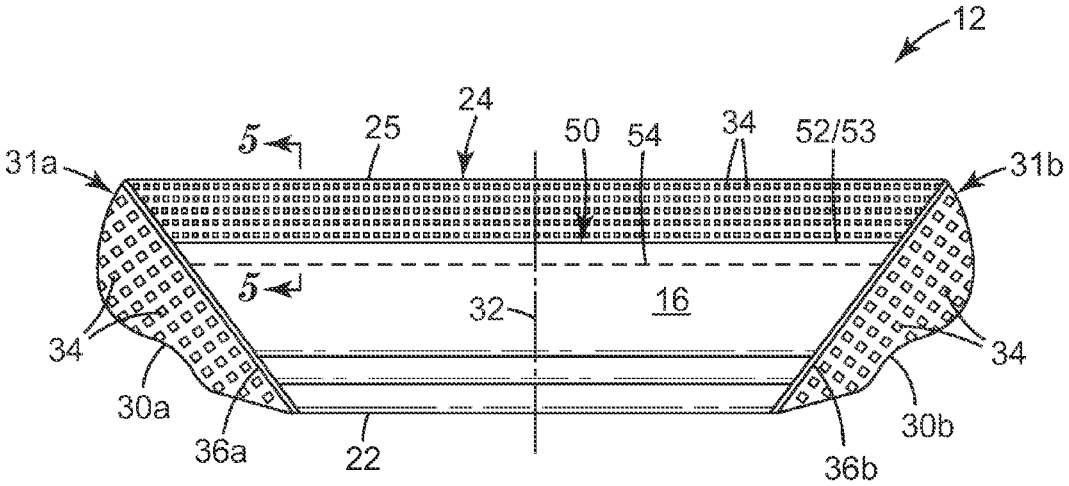
FIG. 4 is a top plan view of a mask body 12 in a collapsed configuration, prior to bonding the dart.

Turning now to FIG. 4, FIG. 4 shows the mask body 12 from the respirator 10 in a folded or collapsed configuration, prior to having the dart formed therein, with additional features called out in this configuration. In this flat, collapsed configuration, various features such as the line of demarcation 22 are seen, as well as first and second flanges 30*a* and 30*b* at opposing sides 31*a*, 31*b* of the mask body 12.

A center plane 32 bisects the mask body 12 to define the first and second sides 31*a*, 31*b*. The first and second flanges 30*a* and 30*b* located on opposing sides 31*a* and 31*b*, respectively, of the mask body 12 can be readily seen. The flanges 30*a*, 30*b* extend away from the filtering structure 16 of the mask body 12 at a line of demarcation 36*a* at side 31*a* and a line of demarcation 36*b* in a generally planar manner. The flanges 30*a*, 30*b* may be an extension of filtering structure 16, or they may be made from a separate material such as a rigid or semi-rigid plastic. Although the flanges 30*a*, 30*b* may comprise one or more or all of the various layers that comprise the mask body filtering structure 16, the flanges 30*a*, 30*b* are not part of the primary filtering area of the mask body 12.

Unlike the filtering structure 16, the layers that comprise the flanges 30*a*, 30*b* may be compressed, rendering them nearly fluid impermeable. The flanges 30*a*, 30*b* can have welds or bonds 34 thereon to increase flange stiffness, and the mask body perimeter 24 also may have a series of bonds or welds 34 to join the various layers of the mask body 12 together and also to maintain the position of the nose clip 35. The remainder of the filtering structure 16—inwardly from the perimeter 24—may be and preferably is fully fluid permeable over much of its extended surface, with the possible exception of areas where there are bonds, welds, or fold lines.

The respirators of this invention include at least one permanent dart 60 formed in the mask body 12, the dart 60 extending transversely across the mask body 12, from one side 31*a* of the mask through the center plane 32 to the other side 31*b*.

The dart 60 is formed by securing (e.g., sealing, welding or otherwise bonding) a partially-open pleat close to its ends while leaving the center open. The securement 55 locks the three layers of the pleat into the double-tapering dart configuration. In accordance with this invention, the securement 55 is formed a distance from the perimeter edge 25 of the mask body 12, to reduce the stiffness of the mask body 12 at its perimeter 24 and to allow better forming of the mask body 12 to the wearer's face. Additionally, having the securement 55 a distance from the perimeter edge 25 provides for usable filtering structure on either transverse side of the securement 55.

FIGS. 4 through 9 illustrate the various configurations of the mask body 12 when forming the dart 60. It is noted that the various elements of the mask body 12 of these five figures are interchangeable among the figures, and although a feature may not be specifically called out in a particular figure, the element is present unless it is contrary to the particular figure.

Figure 5:
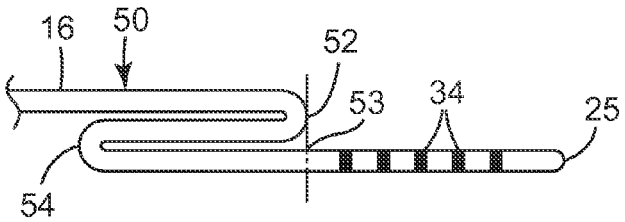
FIG. 5 is a cross-sectional view of the pleat 50 taken along lines 5-5 of FIG. 4.

In FIG. 4, the mask body 12, in a folded or collapsed configuration, has a pleat 50 extending from the line of demarcation 36*a* at side 31*a* to the line of demarcation 36*b* at side 31*b*. At these lines 36*a*, 36*b*, the pleat 50 is locked, but the pleat 50 can be opened as it nears the center plane 32. FIG. 5 illustrates features of the pleat 50, which are also seen in FIG. 4, including the external fold 52 and the internal fold 54, and a line 53 where the external fold 52 terminates in relation to the filtering structure 16. In the configuration of FIG. 4, because the entire length of pleat 50 is in an unopened state, the external fold 52 overlaps the line 53.

Figure 6:
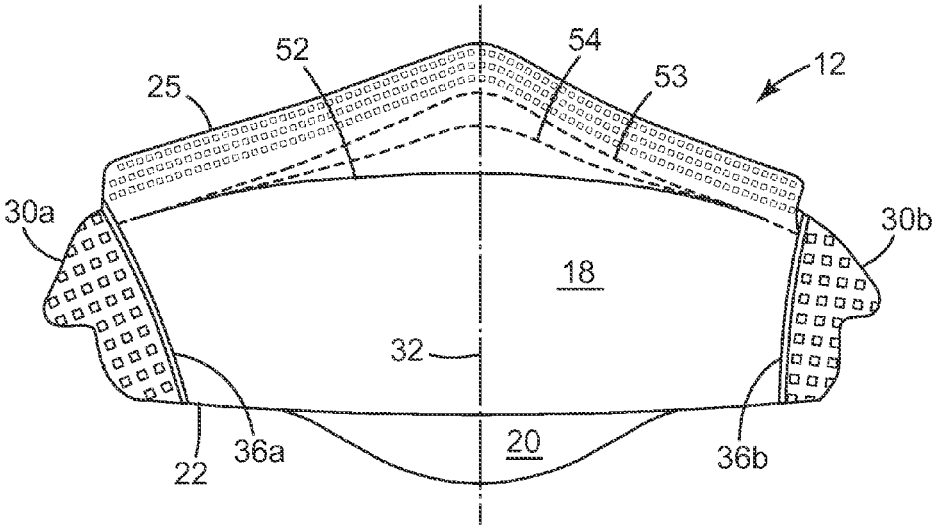
FIG. 6 is a top plan view of the mask body 12 of FIG. 4 in a partially opened cup-shape configuration, prior to bonding the dart.

FIG. 6 shows the mask body 12 from the front in a partially opened configuration, with the top portion 18 separated at least slightly from the bottom portion 20; in this partially opened configuration, the mask body 12 is beginning to take on a cup-shape configuration. As can be seen, the pleat 50 has opened at least partially, separating the external fold 52 from the line 53 and exposing the internal fold 54. The external fold 52 and line 53 are locked in relation to each other at the lines of demarcation 36*a*, 36*b* but the distance between fold 52 and line 53 increases towards the center plane 32, resulting in two areas tapering from the center plane 32 to the lines of demarcation 36*a*, 36*b* and the flanges 30*a*, 30*b*. These tapering regions, at this stage, can be collapsed to return external fold 52 and line 53 together again.

Figure 7:
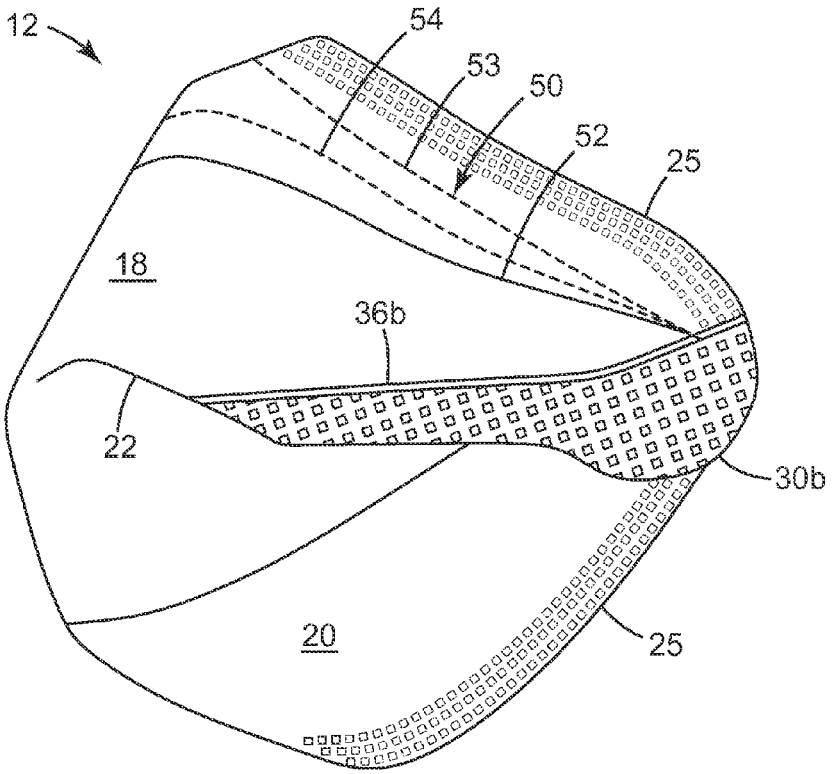
FIG. 7 is a side view of the mask body 12 of FIG. 6.

FIG. 7 shows the mask body 12 from a side thereof, in a fully opened configuration and with the flange 30*b* (and unseen flange 30*a*) folded to be in contact with the filtering structure 16. The cup-shaped configuration of the mask body 12, formed by the top portion 18 and the bottom portion 20, is readily identifiable. The pleat 50 is at least partially open, separating the external fold 52 from the line 53 thus exposing the internal fold 54 and forming two tapering areas extending to the lines of demarcation.

Figure 8:
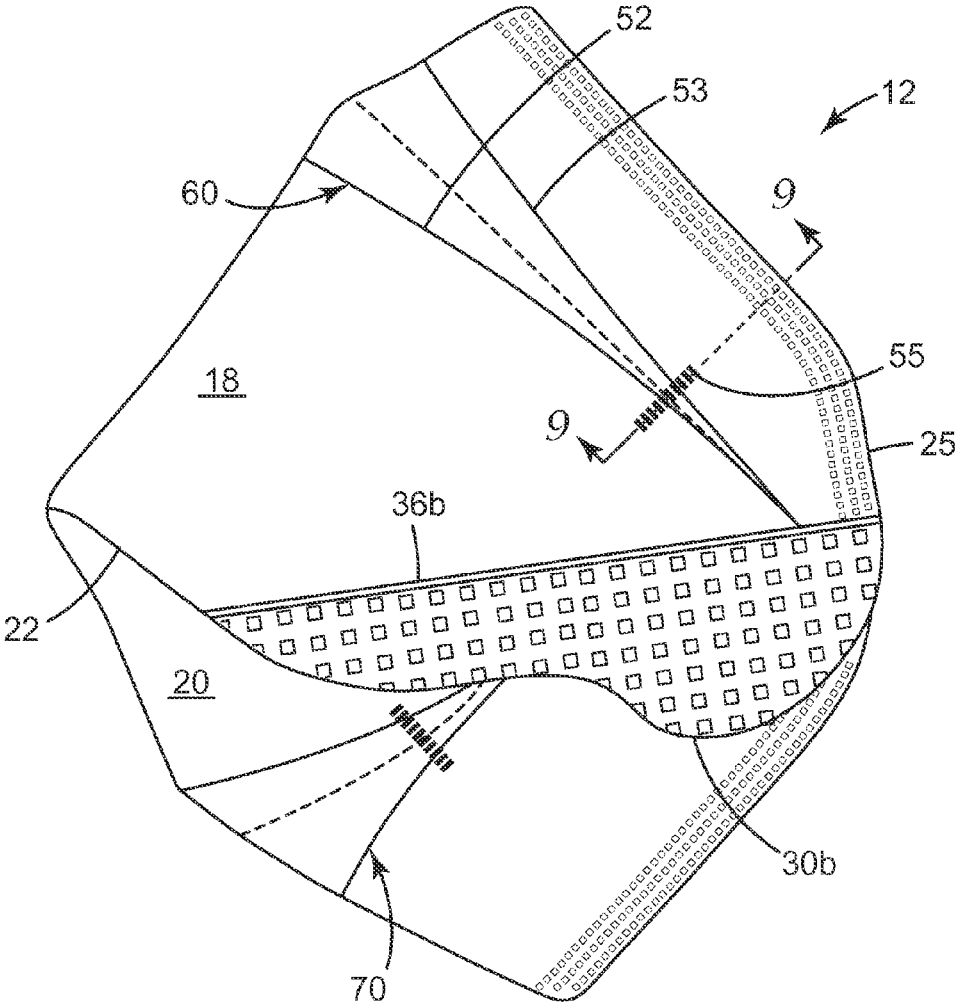
FIG. 8 is a side view of the mask body 12 in a fully opened, cup-shaped configuration with the dart 60 and an optional secondary dart 70.
Figure 9:
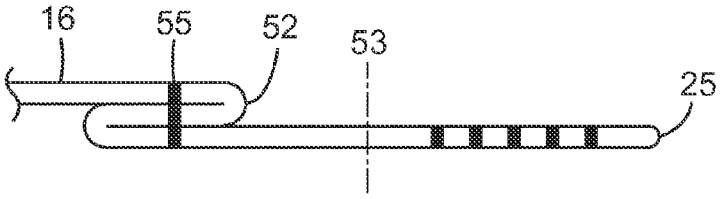
FIG. 9 is a cross-sectional view of the pleat 50 taken along lines 9-9 of FIG. 8.

In FIG. 8, a securement 55 has been formed across the pleat (i.e., across external fold 52 and line 53 and thus internal fold 54) resulting in bonded dart 60. The securement 55 locks together the three individual layers of the filtering structure 16 and the sets the distance between external fold 52 and line 53. FIG. 9 shows the three layers of filtering structure 16 secured and the partially opened pleat, with fold 52 not aligned with but offset from line 53.

The securement 55 may be any mechanism that is applied to hold or fix the external fold 52 in relation to the line 53, or, to hold or fix the three layers of filtering structure 16. Examples of securement mechanisms include, for example, adhesive, a mechanical fastener or attachment (e.g., staple, sewing, rivet), or welding (e.g., ultrasonic and/or thermal welding (which includes heat and pressure)).

The securement 55 is positioned along the pleat at a location distanced from the perimeter 24 and edge 25 of the mask body 12. A portion of the pleat is present between the securement 55 and the perimeter 24 and edge 25, and in the illustrated embodiment, between the line of demarcation 36*b*. By having a portion of unsecured or unsealed length of the pleat, the rigidity and stiffness of the mask body 12 at its perimeter 24 where it contacts the wearer's face is less than if the securement 55 was at the perimeter 24, due in part to the usable (e.g., breathable) filtering structure 16 on either side of the securement 55. This provides for better fit and sealing of the mask body 12 to the wearer's face than if the securement 55 was at the perimeter 24. This distance, between securement 55 and perimeter 24, particularly perimeter edge 25, is at least 5 mm (0.5 cm), at least 10 mm (1 cm) and in some embodiments 25 mm (2.5 cm).

In the mask body 12 of FIG. 8, a second bonded dart 70 is illustrated below the line of demarcation 22 in the bottom portion 20. This second dart 70 extends from the line of demarcation 36*b* through the center plane 32 (FIG. 6) to the other line of demarcation 36*a* (FIG. 6). Second dart 70 further increases the strength of the mask body 12 and inhibits is collapse. Although two darts 60, 70 are illustrated in the particular embodiment, other embodiments may include three or more darts, each extending transversely across the mask body 12.

Figure 10:
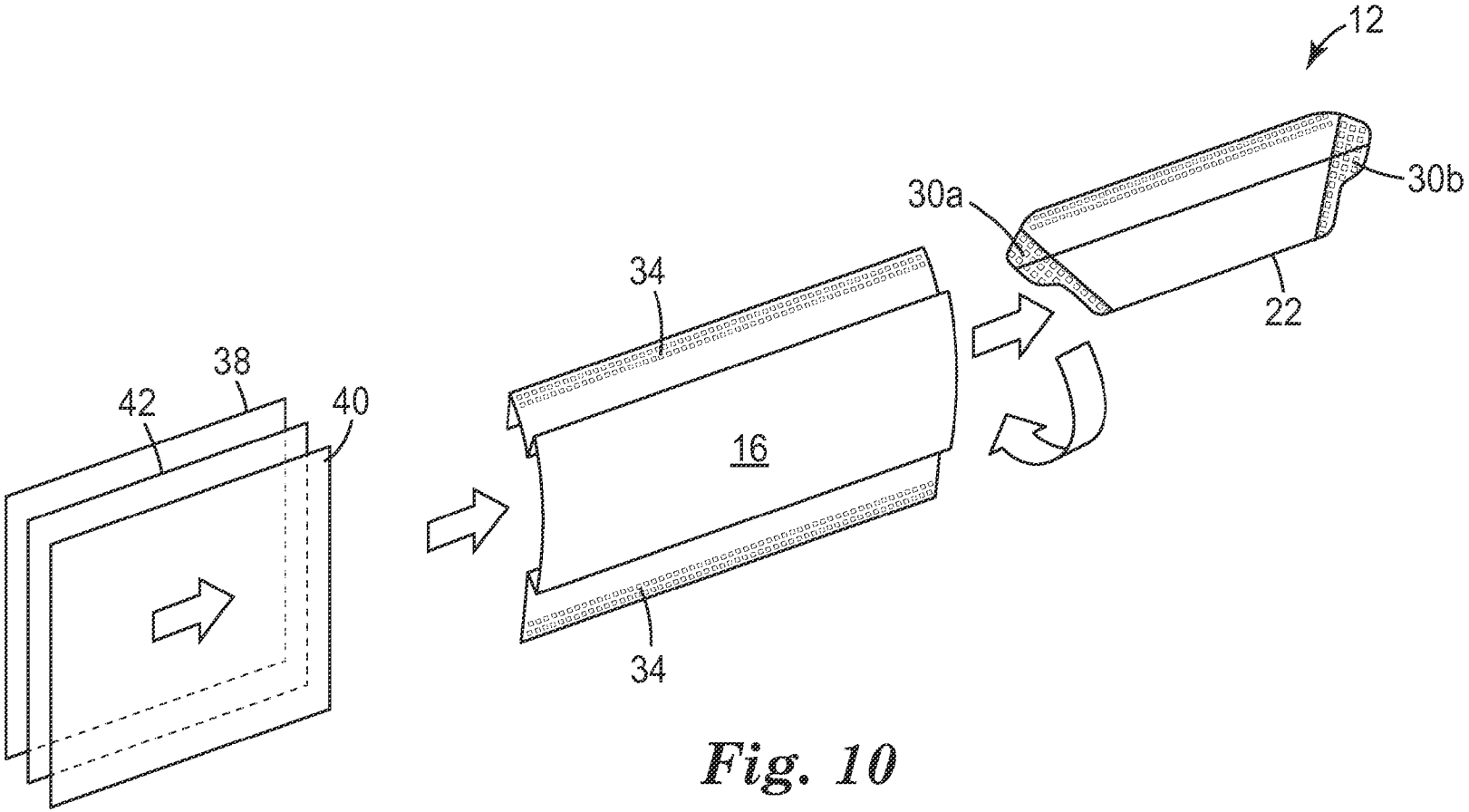
FIG. 10 is a schematic process for forming the mask body 12 of FIG. 4, which can be formed into the respirator 10 having a dart 60.

FIG. 10 illustrates an exemplary method for forming a mask body 12 which can be subsequently form into the filtering face-piece respirator 10 having the at least one bonded dart 60. Particularly, this method shown in FIG. 10 forms the mask body 12 of FIG. 4, after which the method of forming the bonded dart 60 is as explained above in reference to FIGS. 4 and 6 through 8. The mask body 12 is assembled in two operations—mask body making and mask finishing. The mask body making stage includes (a) lamination and fixing of nonwoven fibrous webs to form the filtration structure, (b) formation of various pleat crease lines, (c) formation of various bonded areas in the filtering structure including sealing the lateral mask edges, and (d) cutting the final form, which may be done in any sequence(s) or combination(s). The mask finishing operation includes (a) forming a cup-shaped structure, (b) folding the flanges to contact the filtration structure, (c) forming and bonding the darts, and (d) attaching a harness (e.g., straps). At least portions of this method can be considered a continuous process rather than a batch process; for example, the mask body can be made by a process that is continuous in the machine direction.

Referring to FIG. 10, three individual material sheets, an inner cover web 38, an outer cover web 40, and a filtration layer 42, are brought together and plied face-to-face to form an extended length of filtering structure 16. These materials are laminated together, for example, by adhesive, thermal welding, or ultrasonic welding, and cut to desired size. Welds or bonds 34 may be formed on the extended length of filtering structure 16.

The filtering structure 16 laminate is then folded and/or pleated and various seals and bonds are made to form various features, such as the demarcation line 22 and flanges 30*a*, 30*b*, on the flat mask body 12. In some embodiments, the filtering structure 16 is cut to desired size, typically a length suitable for a single mask, after forming of the demarcation line 22 and/or other folds, pleats and various seals and bonds.

The bonded dart 60 can then be formed in the mask body 12 as described above.

Straps 26, 27 (FIG. 1) can be added to the mask body 12 at any stage; for example, to the flat mask as in FIG. 4, to the partially opened cup shape as in FIG. 6, to the fully opened cup shape as in FIG. 7, or to the fully opened cup shape with bonded flanges and dart 60 as in FIG. 8.

This invention may take on various modifications and alterations without departing from its spirit and scope. For example, an alternate face mask could be molded from filtering structure, using well known male-female molding techniques, with a dart as described herein. A pleat extending transversely across the mask could be sealed at securement areas distanced from the perimeter of the mask to form a dart. The resulting securement area would have breathable material on either transverse side of the area.

Accordingly, this invention is not limited to the above-described but is to be controlled by the limitations set forth in the following claims and any equivalents thereof.

This invention also may be suitably practiced in the absence of any element not specifically disclosed herein.

All patents and patent applications cited above, including those in the Background section, are incorporated by reference into this document in total. To the extent there is a conflict or discrepancy between the disclosure in such incorporated document and the above specification, the above specification will control.

What is claimed is:

1. A filtering face-piece respirator that comprises:

(a) a harness; and (b) a mask body comprising a filtering structure and having a first side edge on a first side of the mask body, a second opposite side edge on a second side of the mask body, and a perimeter, the filtering structure folded into a three-layer pleat at the side edges and sealed to itself at a location on the first side of the mask body distanced from the perimeter to create a transversely extending dart, wherein the mask body further comprises an unsealed length of pleat between the sealed location and the first side edge, and wherein the mask body further comprises first and second flanges located at the first and second opposing sides, the first and second flanges each being folded inwardly to contact the filtering structure when the mask body is in an in-use configuration, wherein the transversely extending dart extends from the first flange to the second flange.

2. The filtering face-piece respirator of claim 1, wherein the pleat is sealed at least 5 mm from the perimeter.

3. The filtering face-piece respirator of claim 1, wherein the pleat is sealed by a welded area.

4. The filtering face-piece respirator of claim 1, the face mask having a line of demarcation separating the face mask into a top portion and a bottom portion, and the transversely extending dart is located in the top portion.

5. The filtering face-piece respirator of claim 1, further comprising a second transversely extending dart located in the bottom portion.

6. The filtering face-piece respirator of claim 1, wherein the three-layer pleat is sealed to itself at a second location on the second side of the mask body, wherein the mask body further comprises an unsealed length of pleat between the second sealed location and the second opposite side edge.

7. A filtering face-piece respirator that comprises:

(a) a harness; and (b) a mask body comprising a filtering structure and having a first side, a second opposite side, a center plane and a perimeter, the mask body having a dart transversely extending from the first side to the second side, the dart comprising a first securement on the first side and a second securement on the second side, wherein the mask body further comprises an unsealed length of dart between the first securement and the first side, and wherein the mask body further comprises first and second flanges located at the first and second sides, respectively, the first and second flanges each being folded inwardly to contact the filtering structure, with the transversely extending dart extending from the first flange to the second flange and with breathable filtering structure present between the first securement and the first flange and breathable filtering structure present between the second securement and the second flange.

8. The filtering face-piece respirator of claim 7, wherein the first and second securements are each at least 5 mm from the perimeter.

9. The filtering face-piece respirator of claim 7, wherein the first and second securements each comprise a welded region.

10. The filtering face-piece respirator of claim 7, the mask body having a line of demarcation separating the mask body into a top portion and a bottom portion, and the transversely extending dart is located in the top portion.

11. The filtering face-piece respirator of claim 10, further comprising a second transversely extending dart located in the bottom portion.

12. The filtering face-piece respirator of claim 7, wherein the first flange extends away from the filtering structure of the mask body at a first line of demarcation, wherein the second flange extends away from the filtering structure of the mask body at a second line of demarcation.

13. The filtering face-piece respirator of claim 12, wherein the dart extends from the first line of demarcation to the second line of demarcation.

14. The filtering face-piece respirator of claim 13, wherein the mask body further comprises an unsealed length of dart between the second securement and the second line of demarcation.

* * * * *